US007431533B1

(12) United States Patent
Oda

(10) Patent No.: US 7,431,533 B1
(45) Date of Patent: Oct. 7, 2008

(54) FLOATING LEVEE SHEET

(75) Inventor: Toshikazu Oda, Tokyo (JP)

(73) Assignee: ENTECH Corporation, Tokyo (JP)

( * ) Notice: Subject to any disclaimer, the term of this patent is extended or adjusted under 35 U.S.C. 154(b) by 0 days.

(21) Appl. No.: 11/806,866

(22) Filed: Jun. 5, 2007

(51) Int. Cl.
*E02B 3/12* (2006.01)

(52) U.S. Cl. ..... 405/107; 405/115; 405/16

(58) Field of Classification Search ..... 405/15, 405/16, 17, 107, 114, 115, 87, 96
See application file for complete search history.

(56) References Cited

U.S. PATENT DOCUMENTS

| | | | | |
|---|---|---|---|---|
| 1,039,579 A * | 9/1912 | Neames | 405/19 |
| 4,089,180 A * | 5/1978 | McCreary | 405/91 |
| 4,184,786 A * | 1/1980 | Richards | 405/108 |
| 5,605,416 A * | 2/1997 | Roach | 405/21 |
| 5,951,202 A * | 9/1999 | Brown | 405/19 |
| 6,692,188 B1 * | 2/2004 | Walker et al. | 405/115 |

FOREIGN PATENT DOCUMENTS

| | | |
|---|---|---|
| JP | 58135210 A * | 8/1993 |
| JP | A-2006-144294 | 6/2006 |

* cited by examiner

*Primary Examiner*—Frederick L Lagman
(74) *Attorney, Agent, or Firm*—Posz Law Group, PLC

(57) ABSTRACT

A floating levee sheet which prevents the river water from overflowing the levee, and a plurality of which are interconnected to cover the waterside levee slope comprising; a watertight sheet body that forms an internal space by being upwardly folded at the upper end; and a loading bag section constructed at the lower end of the sheet body with an open top portion; and a float which is fixed on the sheet body in the across-the-width direction at the upper part of the internal space, and is filled with air and hermetically sealed; and a plurality of joining members whose one end is secured to the upper end of the sheet body, and whose other end comprises an anchoring section to be anchored to the levee top over the anchoring section of the sheet body, and through the intervals of which the overflowing water enters the internal space.

6 Claims, 7 Drawing Sheets

FLOATING LEVEE SHEET

BACKGROUND

1. Technical Field

The present invention relates to a floating levee sheet that stops river water from overflowing a levee that is built along a river or the like, and prevents the levee breach.

2. Related Art

Recent years have seen a rapid change in ground conditions due to the increased number of housing-land development and land redevelopment projects that require massive-scale logging operations or the like in the mountainous areas.

On the other hand, abnormal weather events are reported due to the climate changes caused by global warming or the like which is a result of increased energy consumption by the technological innovation as well as population increase.

These natural environment changes have brought about heavy rainfalls at the time of bad weather, or a number of cases of unusually heavy rainfall linked with the abnormally frequent typhoon generation. Because of the impaired water-retaining capacity of the forest due to the logging in the mountainous areas, such abnormally heavy rainfalls cause flash flooding and/or mud flooding which results in abnormally rapid water rise in the river, and thus, more frequent levee breach cases.

Conventionally, sandbags containing earth and sand or the like that are piled on the levee top have been used to prevent levee breach.

SUMMARY

A first aspect of the invention provides a floating levee sheet for covering a waterside levee slope by interconnecting a plurality of floating levees to prevent water from overflowing a levee, comprising: a watertight sheet body that forms an internal space by being upwardly folded at an upper end thereof; a loading bag section provided at a lower end of the sheet body with an open top portion; a float member fixed at an upper portion of the sheet body in a width direction within the internal space, in which air is filled and hermetically sealed; a plurality of joining members, one end of each joining member being secured to the upper end of the sheet body, other end of each joining member having an anchoring section to be anchored to a levee top together with an anchoring section of the sheet body, the joining members allowing the overflowing water to enter into the internal space through spaces formed between adjacent joining members; and anchoring means for anchoring the anchoring section on the other end of the joining member together with the anchoring section of the sheet body onto the levee top.

The first aspect of the invention provides a floating levee sheet which is a lightweight structure and easy to transport.

Also, the floating levee sheet is simple and easy to install, requiring only a short period of time to install on the levee or the like.

A second aspect of the invention provides the floating levee sheet according to the first aspect of the invention, in which the anchoring section on the other end of the joining member comprises a plurality of adjusting members capable of adjusting a distance between the upper end of the sheet body where the one end of the joining member is secured and the anchoring section of the sheet body.

According to the second aspect of the invention, since the anchoring section on the other end of the joining member is comprised of a plurality of adjusting members capable of adjusting a distance between the upper end of the sheet body where one end of the joining member is secured and the anchoring section of the sheet body, the floating levee sheet can be installed in such a manner as to correspond to the water level and/or the strength of the swollen water.

A third aspect of the invention provides the floating levee sheet according to the second aspect of the invention, wherein the anchoring section of the sheet body is a hole perforated in the sheet body; and the adjustment members of the anchoring section on the other end of the joining member are eyelets; and the anchoring means comprises a stake that is put through the hole and the eyelet, and is hammered into the levee top, and an anchoring ring that presses down the sheet body and the eyelet onto the levee top by putting the stake therethrough.

According to the third aspect of the invention, since the anchoring member comprises a stake that is put through the hole in the sheet body and the eyelet on the joining member, and is hammered into the levee top, and an anchoring ring that presses down the sheet body and the eyelet onto the levee top, the floating levee sheet can be securely anchored on the installation surface.

A fourth aspect of the invention provides the floating levee sheet according to one of first to third aspects, wherein both of the side ends of the sheet body are provided with an interconnecting section that enables a plurality of floating levee sheets to be interconnected with one another in the width direction, and at the same time prevents the levee from water seepage, thus enabling the installation thereof along any desired distance on a levee or the like.

DETAILED DESCRIPTION

Embodiment of the present invention will be described in detail with reference to the accompanying figures.

Figure 1:
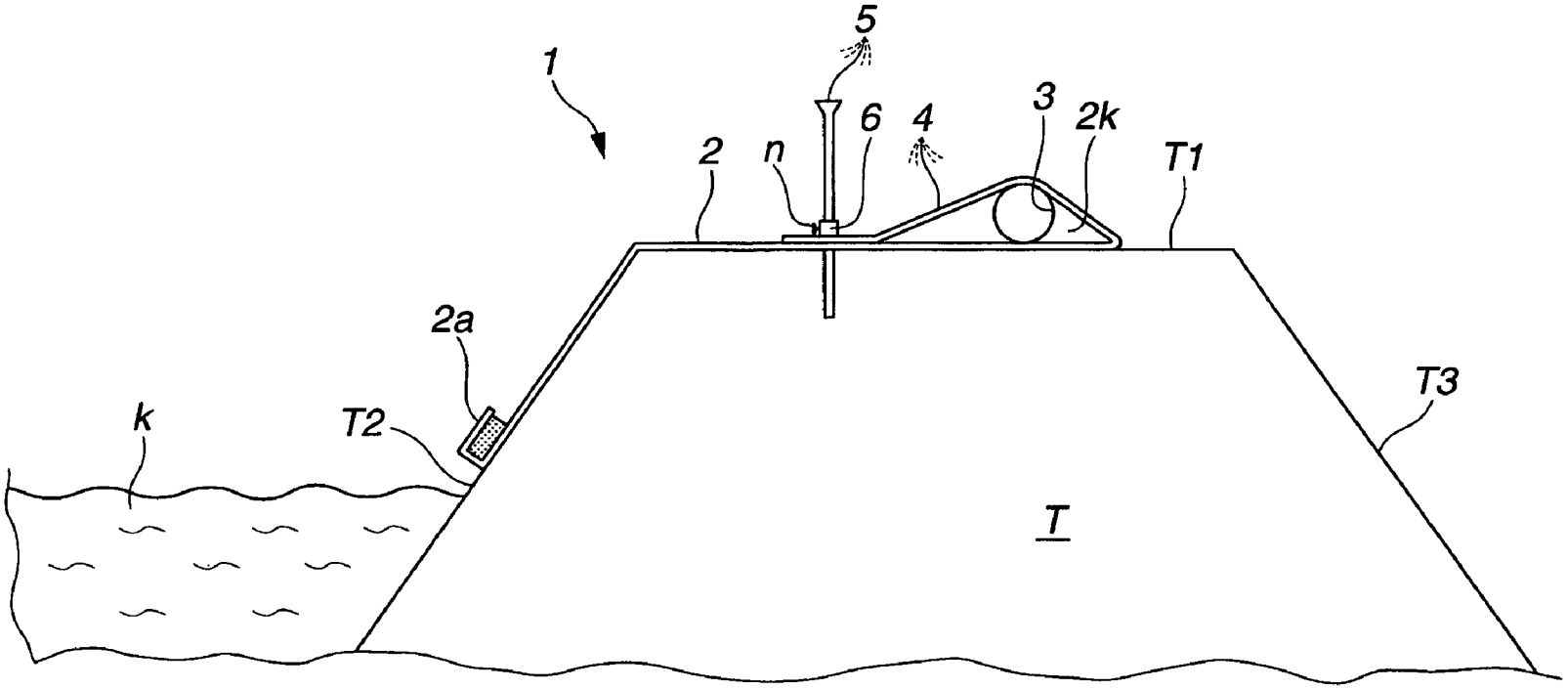
FIG. 1 is a schematic side sectional view of an illustrative embodiment of the invention in which the floating levee sheet is installed on the levee of a river.

The floating levee sheet 1 according to the present invention, as shown in the schematic side sectional view FIG. 1, is used on the levee T that is built along the river k, to stop the river water from overflowing the levee T caused by the water level rise in the river k.

Figure 3:
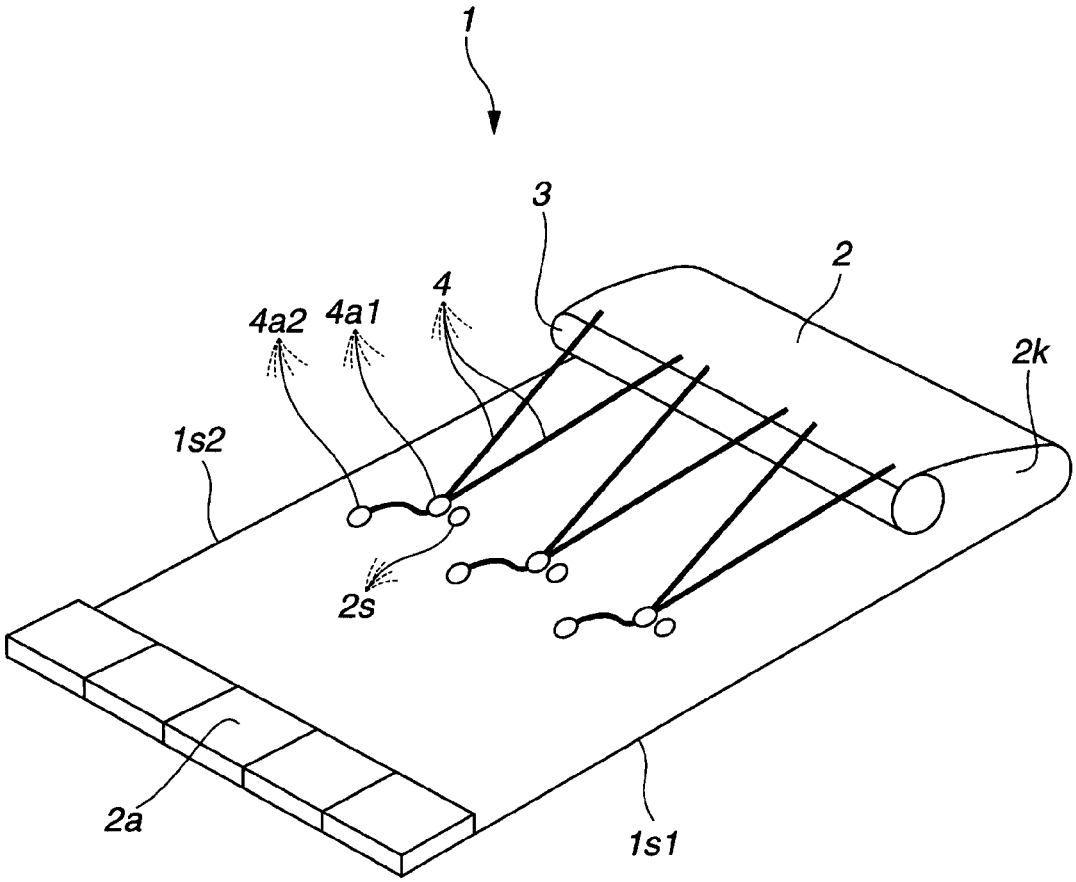
FIG. 3 is a perspective view showing the floating levee sheet of the embodiment.

The floating levee sheet 1 includes a watertight sheet body 2 having a loading bag (loading bag section) 2*a* which contains earth and sand as a weight and which is provided at the lower end of the sheet body, and an internal space 2*k* formed by being upwardly folded at the upper end thereof; an air tube (float) 3 which is fixed, in the width direction (perpendicular to the paper surface of FIG. 1), on the sheet body at the upper part of the internal space, and is filled with air and hermetically sealed, and a plurality of belt-type anchoring ropes (joining member) 4 whose one end is secured to the upper end of the sheet body 2, and whose the other end is secured to the anchoring hole (anchoring section) 2*s* (shown in FIG. 3)

The floating levee sheet 1 is installed on the levee T by a plurality of stakes (anchoring member) 5 each of which is put through one of the eyelets (the anchoring section on the other end of the joining member, adjusting member) 4*a*1, 4*a*2 on the belt-type anchoring rope (joining member) 4 and the anchoring hole in the sheet body 2, and is hammered into the levee top T1, as well as by a stopper ring (anchoring member, anchoring ring) 6.

Figure 2A:
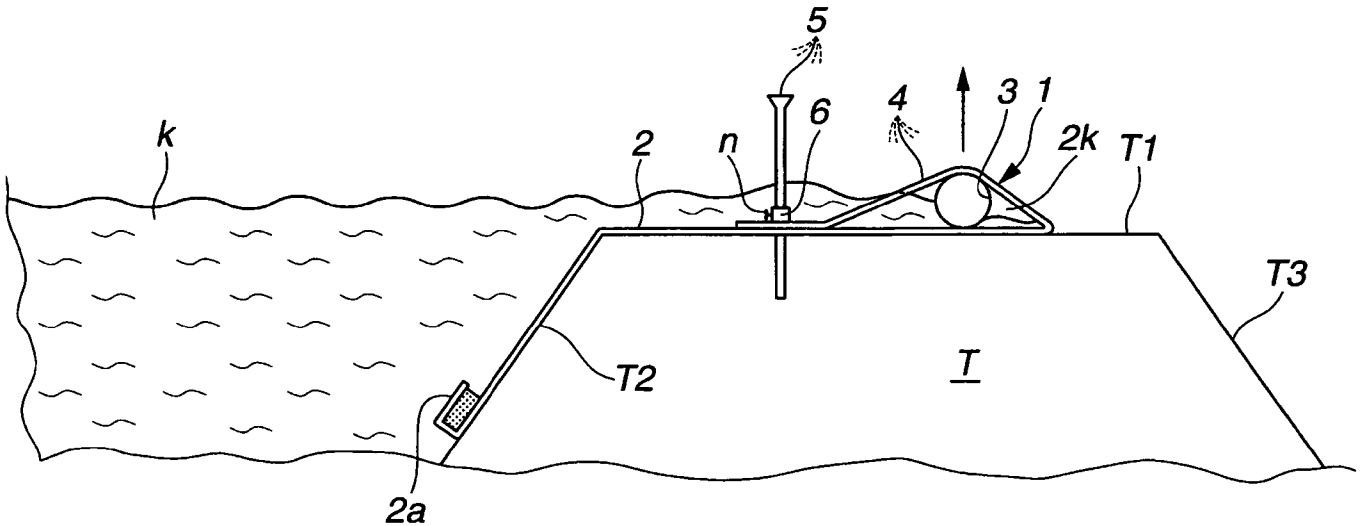
FIGS. 2(*a*) and 2(*b*) are schematic side sectional views depicting the river shown in FIG. 1 in the water level rising processes.
Figure 2B:
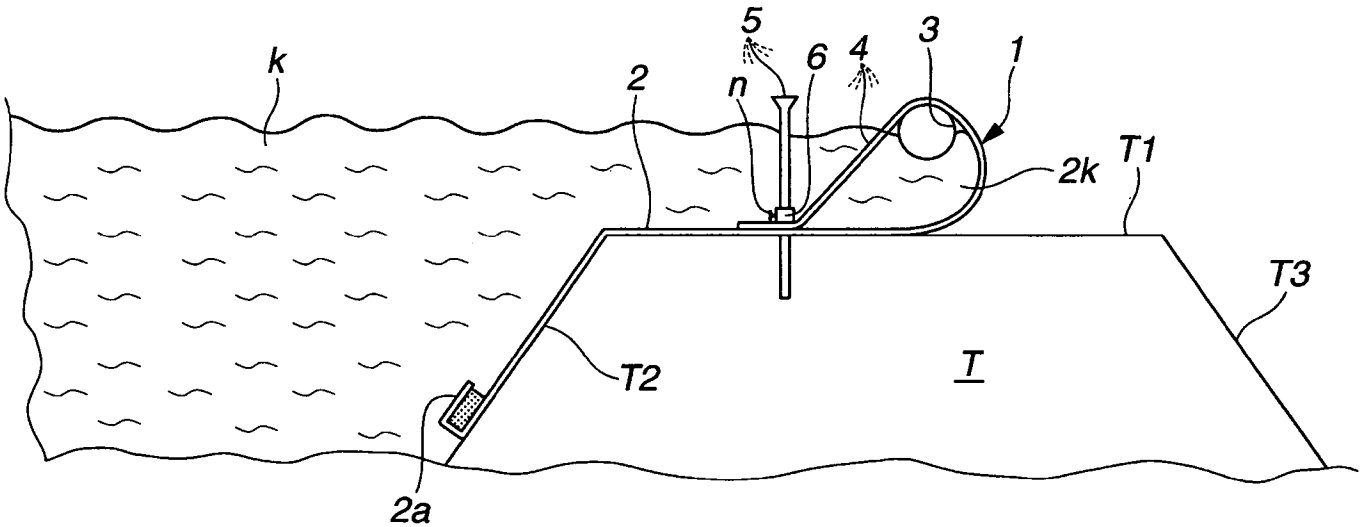

At the time of swollen water in the river k due to excessively heavy rainfall, the overflowing water of the river k rises along the waterside levee slope T2, over the levee top T, through spaces between a plurality of belt-type anchoring ropes 4 (see FIG. 3) of the floating levee sheet 1, and enters the internal space 2*k* formed by the sheet body 2, as shown in the schematic side sectional view FIG. 2(*a*).

In the foregoing event, the waterside levee slope T2 and the levee top T1 are covered by the airtight sheet body 2 that is weighed down by the loading bag 2*a*, thus preventing swollen water from seeping into levee T.

In the event of further water level rise, the air tube 3 rises on the water surface with the watertight sheet body 2 upwardly by the buoyancy of water, as shown by an arrow in FIG. 2(*a*), because the air tube 3 that is filled with air and the filled air put together has lower specific gravity than water.

In the forgoing event, as shown in FIG. 3, the internal space 2*k* of the sheet body 2 is surrounded by the watertight sheet body 2 and the belt-type anchoring rope 4 is secured to the upper end of the sheet body 2, thus preventing the river water from overflowing onto the landside levee slope T3 which is the opposite side of the levee T waterside.

Then as shown in the schematic side sectional view FIG. 2(*b*), eventually the river water that has been rising maintaining the same level as the river water fills the internal space of the sheet body 2, and the air tube 3 stops rising.

As described above, the floating levee sheet 1 can prevent flood when installed on the levee T, and the air tube 3 rises to the water surface along with the water rise, damming the river water with the watertight sheet body 2 and stopping it from overflowing the levee T.

Then, in the even that the water level of the river k drops down, the air tube 3 on the water surface comes down along with the water level, and when the water surface of the river k becomes lower than the levee top T1 of the levee T the floating levee sheet 1 comes back to its original state.

Now, the configuration of the aforementioned floating levee sheet 1 will be described.

The floating levee sheet 1, as shown in FIG. 3, comprises a watertight sheet body 2 as the main part which is made of polyethylene or the like, and is provided with a loading bag 2*a* that is formed on one end thereof by folding and heat-sealing the lower part of the sheet in the upward direction.

The loading bag 2*a* is used to receive gravel, earth, sand or the like to weigh down the sheet, and thus is divided into several rooms to ensure the strength thereof and to prevent the leakage of the content such as earth and sand or the like.

Figure 4A:
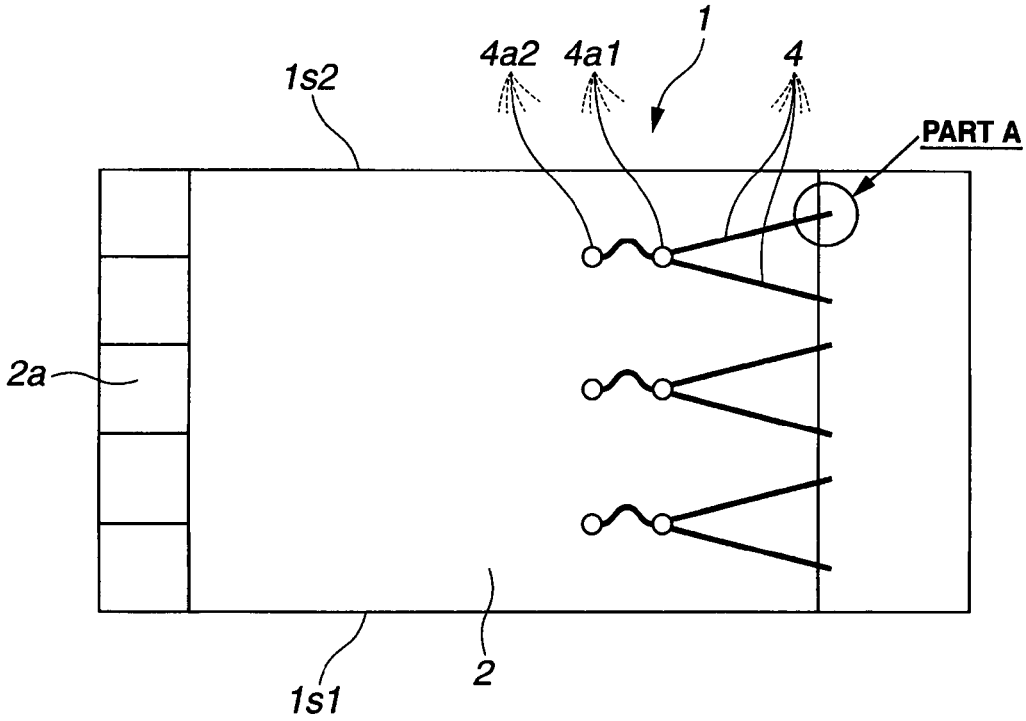
FIGS. 4(*a*) and (*b*) are a top view and a bottom view showing the floating levee sheet of the embodiment.
Figure 4B:
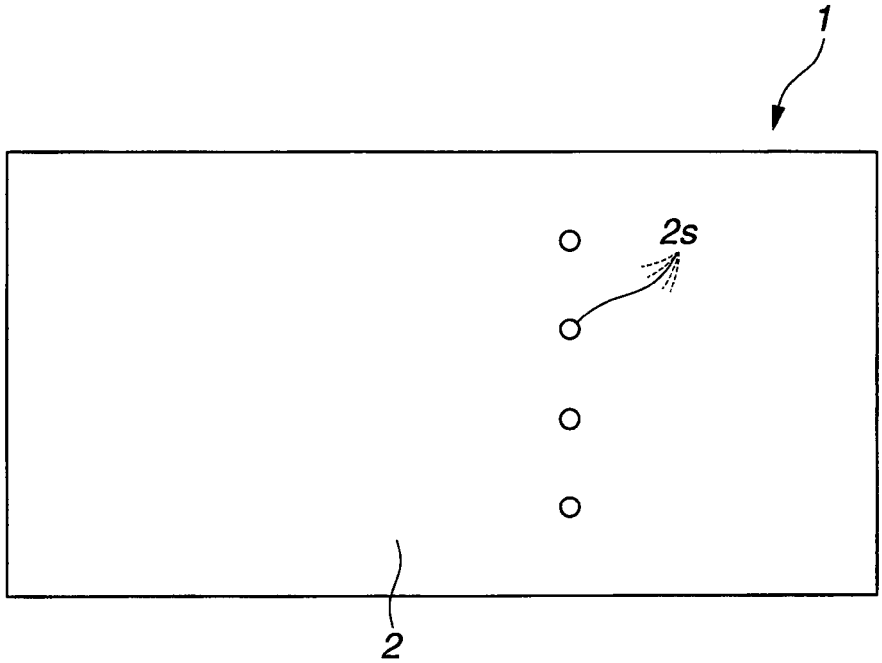

The sheet body 2, as shown in the bottom view FIG. 4(*b*) of the floating levee sheet 1, has a plurality of anchoring holes 2*s* perforated in its center area for putting a plurality of anchoring stakes therethrough.

Also, as shown in FIG. 3, the other end of the floating levee sheet 1 is folded back to form the internal space 2*k*, and the air tube 3 is fixed in the width direction to the sheet body 2 at the upper part of the internal space 2*k* at several spots by Magic tape (registered trademark).

At the time of the floating levee sheet 1 installation the air tube 3 is filled with air, and the air tube 3 is provided on each end thereof with a joint (not shown) that interconnects with the air tube 3 of another floating levee sheet 1 as well as prevents the air leakage.

Figure 5:
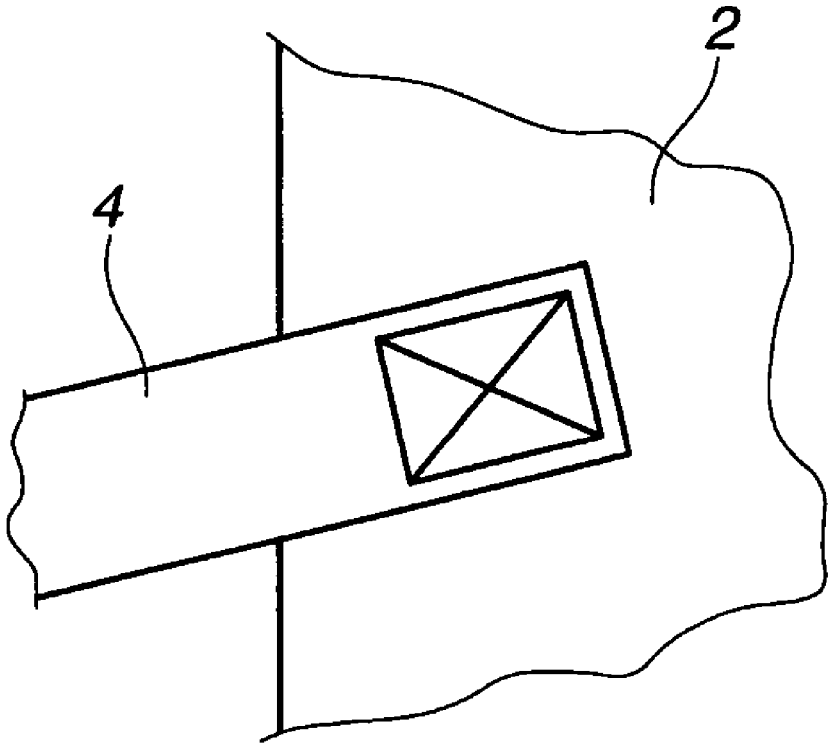
FIG. 5 is an enlarged top view of the part A of the floating levee sheet shown in FIG. 4 (*a*)

Also, as shown in FIG. 4(*a*) depicting the top view of the floating levee sheet 1, one end of the belt-type anchoring rope 4 is secured by sewing onto the outer surface of the other end of the floating levee sheet 1 (as shown in FIG. 5 depicting the enlarged view of the section A in FIG. 4(*a*)), and the other end of the belt-type anchoring rope 4 has the first eyelet 4*a*1 that is fixed by heat seal or the like, and further, the tip end of the extension of the belt-type anchoring rope 4 that is fixed to the first eyelet 4*a*1 has the second eyelet 4*a*2 4 that is fixed by heat seal or the like.

Figure 6:
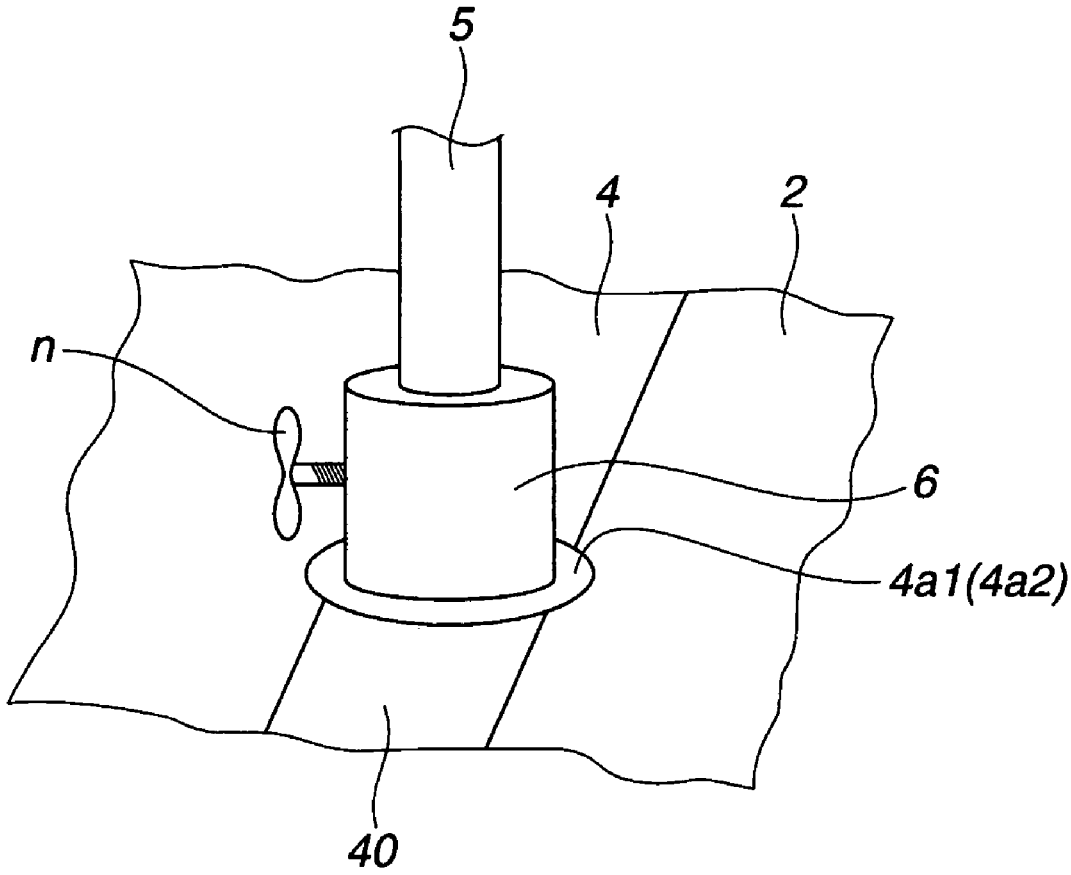
FIG. 6 is an enlarged perspective view showing a state in which the floating levee sheet of the embodiment is anchored by the stake.

Either one of the first eyelet 4*a*1 or the second eyelet 4*a*2 is matched to the anchoring hole 2*s* in the sheet body 2, and the stake 5 is put therethrough and hammered into the levee top T1 of the levee T, as shown in FIG. 1. And, as shown in FIG. 6, the floating levee sheet 1 is installed on the levee T by pressing down the sheet body 2 and either one of the first eyelet 4*a*1 or the second eyelet 4*a*2 by the bottom-end part of the stopper ring 6 which is put through by the stake 5, then by securing the stopper ring 6 to the stake 5 with a wing screw (anchoring member) n.

As described above, the floating levee sheet 1 can be installed securely on the levee T without any interspace between the sheet body 2 and the levee top T1 of the levee T by pressing down either one of the first eyelet 4*a*1 or the second eyelet 4*a*2 and the sheet body 2 with the stopper ring 6.

FIG. 4(*a*) depicts the state in which the first eyelets 4*a*1, . . . of the belt-type anchoring rope 4 is matched with the anchoring holes 2*s*, . . . on the sheet body 2.

As described above, by choosing either one of the first eyelets 4*a*1, 4*a*1, . . . or the second eyelets 4*a*2, 4*a*2, . . . at the time of floating levee sheet 1 installation, the configuration allows the distance adjustment between the upper end of the sheet body 2 to which one end of the belt-type anchoring rope 4 is secured and the anchoring hole 2*s* on the sheet body 2 through which the stake 5 is put, namely, the distance from the air tube 3 to the anchoring hole 2*s* on the sheet body 2 through which the adjustment stake 5 is hammered into.

For example, when the strength of the swollen water in the river k is high and the floating levee sheet 1 is impressed with high water pressure, or when the water rise level due to the swollen water is relatively low, etc., the floating levee sheet 1 is installed on the levee T after selecting and matching the first eyelets 4*a*1, 4*a*1, . . . of the belt-type anchoring rope 4 to the anchoring hole 2*s* on the sheet body 2 and putting the stake 5 through each hole.

In this case, the size of the internal space 2*k* is relatively small because of the shorter distance from the anchoring hole 2*s* in the sheet body 2 which is anchored by the stake 5 to the air tube 3, which results in the lower total water pressure impressed on the sheet body 2, which suits to and can cope with the case in which the water rise level due to the swollen water is low, or the case in which the strength of the swollen water is high.

On the other hand, when the strength of the swollen water in the river k is low and the floating levee sheet 1 is impressed with low water pressure, or when the water rise level due to the swollen water is relatively high, etc., the floating levee sheet 1 is installed on the levee T after selecting and matching the second eyelets 4*a*2, 4*a*2, . . . of the belt-type anchoring rope 4 to the anchoring hole 2*s* on the sheet body 2 and putting the stake 5 through each hole.

In this case, the size of the internal space 2*k* is relatively large because of the longer distance from the stake 5 to the air tube 3, which results in the higher total water pressure impressed on the sheet body 2, which suits to and can cope with the case in which the water rise level due to the swollen water is high, or the case in which the strength of the swollen water is low.

Figure 7:
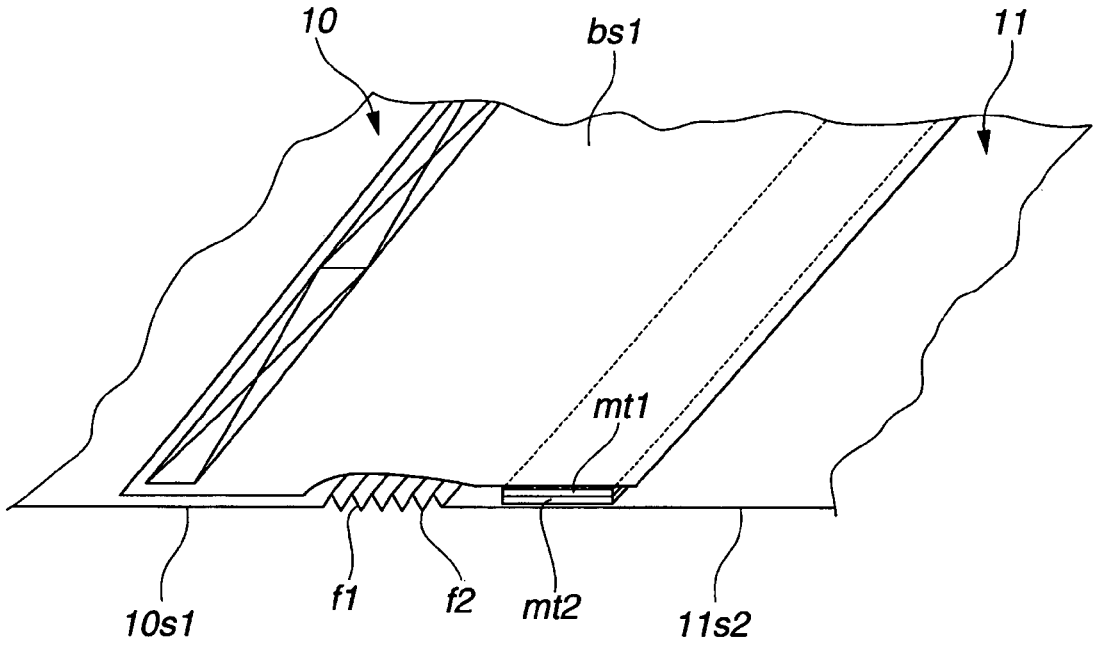
FIG. 7 is an enlarged perspective view showing a state in which the floating levee sheets of the embodiment are interconnected.

For interconnecting a plurality of floating levee sheets 1 with the aforementioned configuration (as shown in FIG. 3) and installing them along the levee T (perpendicular to the paper surface in FIG. 1), the floating levee sheet has, on the both side ends 1*s*1, 1*s*2, means for interconnecting the floating levee sheets in the width direction, as shown in FIG. 7.

More specifically, one floating levee sheet 10 is provided with an industrial fastener (registered trademark) (interconnecting section) f1 at the edge of one side end 10 *s*1, and a watertight interconnecting sub-sheet (interconnecting section) bs1 is fixed by sewing at one end thereof to the sheet body in such a way as to cover the industrial fastener (registered trademark) f1. The watertight interconnecting sub-sheet (interconnecting section) bs1 is provided with a Magic tape (registered trade mark) (interconnecting section) mt1 on the other end thereof.

On the other hand, another floating levee sheet 11 is provided with an industrial fastener (registered trademark) (interconnecting section) f2 at the edge of one side end 11*s*2, as well as with a Magic tape (registered trade mark) (interconnecting section) mt2 fixed at an inner part relative to the industrial fastener (registered trademark) f2.

As described above, each floating levee sheet 1 is provided with an industrial fastener (registered trademark) f1 at the edge of one side end 1*s*1, and a watertight interconnecting sub-sheet bs1 is fixed by sewing at one end thereof to the sheet body in such a way as to cover the industrial fastener (registered trademark) f1 and also provided with a Magic tape (registered trade mark) mt1 on the other end thereof. Further, each floating levee sheet 1 is provided with an industrial fastener (registered trademark) f2 at the edge of the other side end 1*s*2, as well as with a Magic tape (registered trade mark) mt2 fixed at an inner part relative to the industrial fastener (registered trademark) f2.

With the aforementioned configuration, when interconnecting one floating levee sheet 10 with another floating levee sheet 11 in the width direction, first, the industrial fastener (registered trademark) f1 of one floating levee sheet 10 and the industrial fastener (registered trademark) f2 of another floating levee sheet 11 are fastened and closed.

Then, by the watertight interconnecting sub-sheet bs1 of one floating levee sheet 10, the fastened the industrial fasteners (registered trademark) f1 and f2 are covered, and the Magic tape (registered trade mark) mt1 on the watertight interconnecting sub-sheet bs1 is attached to the Magic tape (registered trade mark) mt2 on another floating levee sheet 11 to interconnect one floating levee sheet 10 with another floating levee sheet 11 in the width direction.

Now, since the watertight interconnecting sub-sheet bs1 is secured in such a way as to cover the industrial fasteners (registered trademark) f1 and f2, the water leak from a gap between one floating levee sheet 10 and another floating levee sheet 11 which are interconnected with one another onto the levee T can be prevented as little as possible.

According to the aforementioned manner, the floating levee sheet 1 can be interconnected in any desired number in the width direction thereof, enabling its installation along any desired distance of the levee T.

The floating levee sheet 1 itself weighs 23 kg when, for example, the width of the sheet is 10 m and the air tube 3 is filled with air.

Now, the procedures for interconnecting and installing the floating levee sheet 1 along the levee T will be explained.

First, the air tube 3 of each floating levee sheet 1 is filled with air.

Then, as shown in FIG. 1, the floating levee sheet 1 is draped and placed on top of the waterside levee slope T2 of the levee T with earth and sand in the loading bag 2*a* thereof.

Then, either the first eyelets 4*a*1, . . . or the second eyelets 4*a*2, . . . are selected in consideration with the water rise level and/or the strength of the swollen water of the river k, and matched with the corresponding anchoring holes 2*s* in the sheet body 2 as shown in FIG. 3, and stakes 5 are put through the eyelets 4*a*1 as well as the anchoring holes 2*s* and hammered into the levee top T1 of the levee T as shown in FIG. 1, and, as shown in FIG. 6, either of the first eyelets 4*a* . . . or the second eyelets 4*a*2, . . . as well as the sheet body 2 are pressed by the stopper rings 6, . . . , and each of the stopper rings 6 is secured with a wing screw to each of the stakes 5.

The installation of the floating levee sheet 1 onto the levee T is thus completed.

Subsequently, the industrial fastener (registered trademark) f1 of one floating levee sheet 1 and the industrial fastener (registered trademark) f2 of another floating levee sheet 1, which is to be interconnected, are fastened, and the fastened industrial fasteners (registered trademark) f1 and f2 are covered by the watertight interconnecting sub-sheet bs1 of one floating levee sheet 1, and then the sheet body 2 of one floating levee sheet 1 and the sheet body 2 of another floating levee sheet 1 are interconnected by adhering the Magic tape (registered trade mark) mt1 on the watertight interconnecting sub-sheet bs1 to the Magic tape (registered trade mark) mt2 on another floating levee sheet 1, which is to be interconnected.

Then, by interconnecting the air tube 3 of one floating levee sheet 1 with the air tube 3 of another floating levee sheet 1 with a joint, the interconnection of one floating levee sheet 1 with another floating levee sheet 1 is completed.

By repeating the aforementioned procedures to interconnect a desired number of floating levee sheets 1, the floating levee sheets can be installed along any desired distance of levee T.

Needless to say, the aforementioned installation procedures of the floating levee sheet 1 onto the levee T is one of the exemplary embodiments, and obviously installation procedures other than the foregoing may be employed.

For example, the installation may be performed by interconnecting a number of floating levee sheets 1 before hand, and then filling the air tube 3 of each floating levee sheet 1 with air, and then anchoring the interconnected floating levee sheets 1 onto the levee T by the stakes 5 and the stopper rings 6, etc.

The floating levee sheet 1 in the above-mentioned configuration is light in weight, easy to carry, and low-cost as well.

Also, by interconnecting the floating levee sheets 1 in the width direction, their installation along any desired distance of the levee T is possible.

Also, the installing operation of the floating levee sheet 1 and the interconnecting operation of the floating levee sheets 1 with one another is easy and requires a little labor, enabling its installation along any desired distance of the levee T in a short period of time.

Also, by selecting either the first eyelets 4*a*1, . . . or the second eyelets 4*a*2, . . . on the belt-type anchoring rope 4 when installing the floating levee sheet 1 onto the levee T, the installation of the floating levee sheet 1 that suits the water rise level and the strength of the swollen water of the river k is possible.

Therefore, even for a long-distance levee, a low-cost floating levee sheet capable of preventing the levee T from overflow of water as well as preventing the levee T from levee breach can be realized by only a little time and labor.

Although the belt-type anchoring rope 4 in the foregoing exemplary embodiment is provided with 2 eyelets, it can be provided with any number of eyelets.

Also, although a plurality of belt-type anchoring ropes 4 are used in the foregoing exemplary embodiment, they can be replaced with a plurality of common ropes, or with water-conductive mesh-type members, and are not limited to the belt-type anchoring rope 4.

The foregoing description of the exemplary embodiment has been made to explain an application of the invention when the floating levee sheet is installed on the levee, but the present invention can be effectively applied to any slope other than a levee slope such as the mountain surface or the like where the swollen water event is anticipated.

What is claimed is:

1. A floating levee sheet for covering a waterside levee slope by interconnecting a plurality of floating levee sheets to prevent water from overflowing a levee, comprising:

a watertight sheet body that forms an internal space by being upwardly folded at an upper end thereof;

a loading bag section provided at a lower end of the sheet body with an open top portion; and a float member fixed at an upper portion of the sheet body in a width direction within the internal space, in which air is filled and hermetically sealed;

a plurality of joining members, one end of each joining member being secured to the upper end of the sheet body, other end of each joining member having an anchoring section to be anchored to a levee top together with an anchoring section of the sheet body, the joining members allowing the overflowing water to enter into the internal space through spaces formed between adjacent joining members; and anchoring means for anchoring the anchoring section on the other end of the joining member together with the anchoring section of the sheet body onto the levee top.

2. The floating levee sheet according to claim 1, wherein the anchoring section on the other end of the joining member comprises a plurality of adjusting members capable of adjusting a distance between the upper end of the sheet body where the one end of the joining member is secured and the anchoring section of the sheet body.

3. The floating levee sheet according to claim 2, wherein the anchoring section of the sheet body is a hole perforated in the sheet body; and the adjustment members of the anchoring section on the other end of the joining member are eyelets; and the anchoring means comprises a stake that is put through the hole and the eyelet, and is hammered into the levee top, and an anchoring ring that presses down the sheet body and the eyelet onto the levee top by putting the stake therethrough.

4. The floating levee sheet according to claim 1 further comprising an interconnecting section that interconnects a plurality of floating levee sheets with one another in the width direction, and prevents water from immersing into the levee.

5. The floating levee sheet according to claim 2 further comprising an interconnecting section that interconnects a plurality of floating levee sheets with one another in the width direction, and prevents water from immersing into the levee.

6. The floating levee sheet according to claim 3 further comprising an interconnecting section that interconnects a plurality of floating levee sheets with one another in the width direction, and prevents water from immersing into the levee.

* * * * *